United States Patent [19]

Warner

[11] 4,321,598

[45] Mar. 23, 1982

[54] DOUBLE DENSITY DISPLAY DRIVE SYSTEM

[75] Inventor: Richard C. Warner, Morris Plains, N.J.

[73] Assignee: The Singer Company, Stamford, Conn.

[21] Appl. No.: 170,356

[22] Filed: Jul. 21, 1980

[51] Int. Cl.[3] ..... G09G 3/32

[52] U.S. Cl. ..... 340/782; 315/169.3; 340/752

[58] Field of Search ..... 340/176, 701, 752, 782; 315/169.3; 358/59, 241

[56] References Cited

U.S. PATENT DOCUMENTS

| | | | |
|---|---|---|---|
| 3,714,374 | 1/1973 | Sobez | 358/241 |
| 3,987,392 | 10/1976 | Kugelmann et al. | 340/782 X |
| 4,183,021 | 1/1980 | Gerstner | 340/782 X |
| 4,271,408 | 6/1981 | Teshima et al. | 340/782 X |

*Primary Examiner*—David L. Trafton

*Attorney, Agent, or Firm*—David L. Davis; Robert E. Smith; Edward L. Bell

[57] ABSTRACT

A display system utilizing an array of display cells each of which includes a pair of oppositely polarized display elements connected in parallel. One or the other of the display elements in a selected display cell is energized by controlling the direction of current flow through the display cell.

5 Claims, 6 Drawing Figures

DOUBLE DENSITY DISPLAY DRIVE SYSTEM

DESCRIPTION

BACKGROUND OF THE INVENTION

This invention relates to display systems wherein a functional indicium corresponding to a selected function is lit up to indicate such selection and, more particularly, to an arrangement for minimizing the number of required leads between drive circuitry and the display elements.

There are many applications where a selection and/or display arrangement includes a panel having functional indicia imprinted thereon, which indicia are selectively lit up to visually indicate the functional status of the overall system to which the selection/display arrangement is appended. When designing a display arrangement, a primary consideration is the cost of the arrangement. One of the main contributors to the cost of such an arrangement is the total number of power drivers required for the light emitting elements. A common technique for reducing driver cost is to multiplex the display elements in a matrix array of row and column conductors, with a single display element connected at each intersection of a row conductor and a column conductor. In such an arrangement, the number of drivers can be reduced to at most the sum of the number of column conductors plus the number of row conductors while the total number of display elements is equal to the product of the number of column conductors times the number of row conductors. A major disadvantage with such a technique is the number of leads required to operate a given number of display elements. When utilizing integrated circuit chips for driving such a display, there is a practical limitation to the number of connections that can be made to a given integrated circuit chip.

It is therefore an object of this invention to provide a display system with an array of display elements wherein there is an efficient utilization of leads for controlling a given number of display elements.

SUMMARY OF THE INVENTION

The foregoing and additional objects are attained in accordance with the principles of this invention by providing a display system comprising a plurality of display cells each of which includes a pair of oppositely poled and parallel connected display elements and means for selecting a display cell and a direction of current flow therethrough so as to energize a selected one of the pair of display elements within the selected display cell.

BRIEF DESCRIPTION OF THE DRAWINGS

The foregoing will be more readily apparent upon reading the following description in conjunction with the drawings wherein.

DETAILED DESCRIPTION

Figure 1:
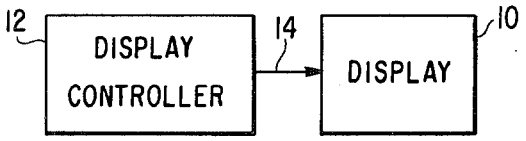
FIG. 1 is a general block diagram of a display system.

Referring now to the drawings, wherein like elements in different figures thereof have the same reference character applied thereto, FIG. 1 shows a display system including a display 10 connected to a display controller 12 via the leads 14. The display 10 may be an array of light emitting elements and the display controller 12 may be a microprocessor or one or more integrated circuit chips. In any event, it is desirable to limit the number of leads 14 coupling the display controller 12 to the display 10.

Figure 3:
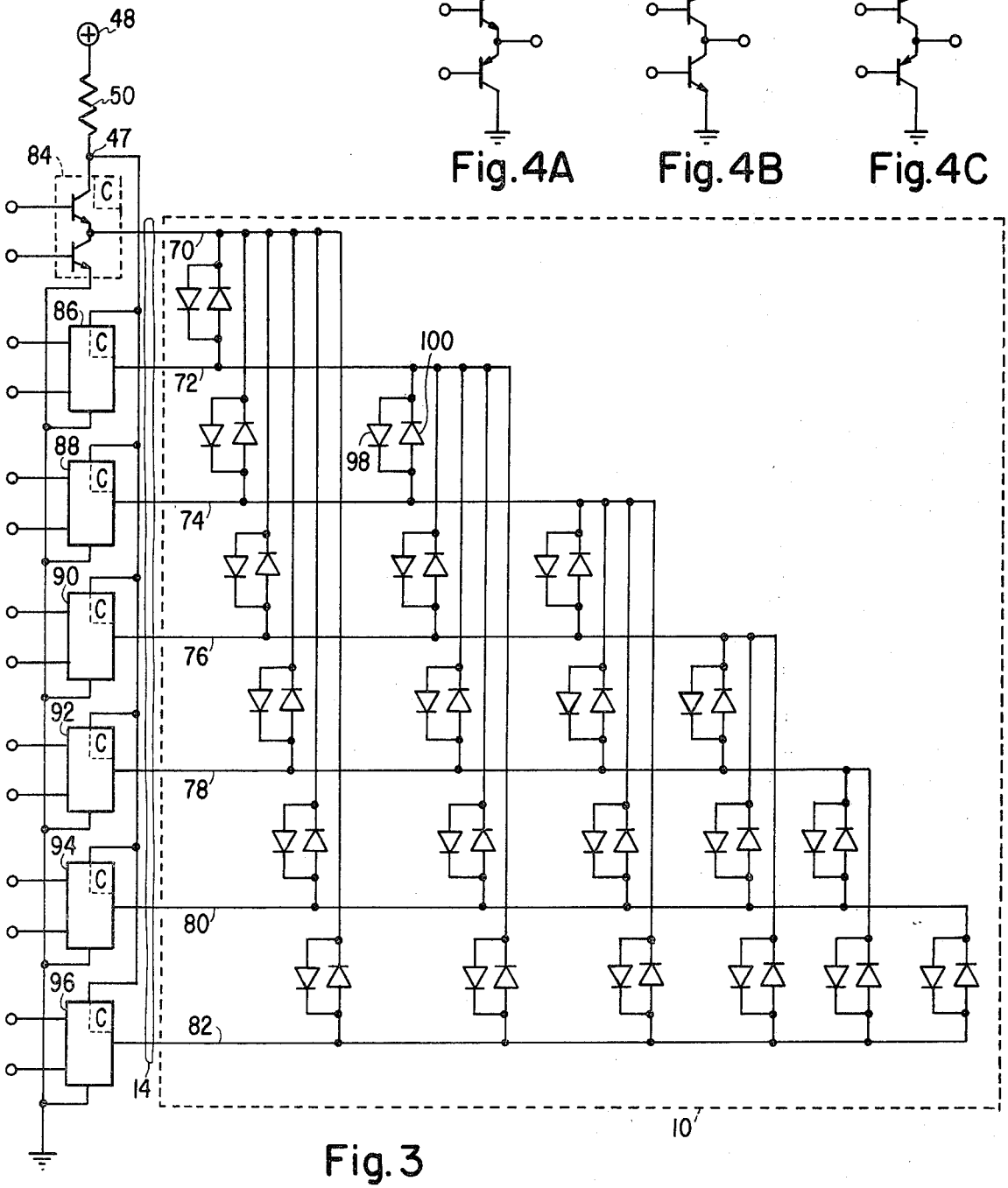
FIG. 3 is a schematic circuit diagram of a second illustrative display system constructed in accordance with the principles of this invention.
Figure 2:
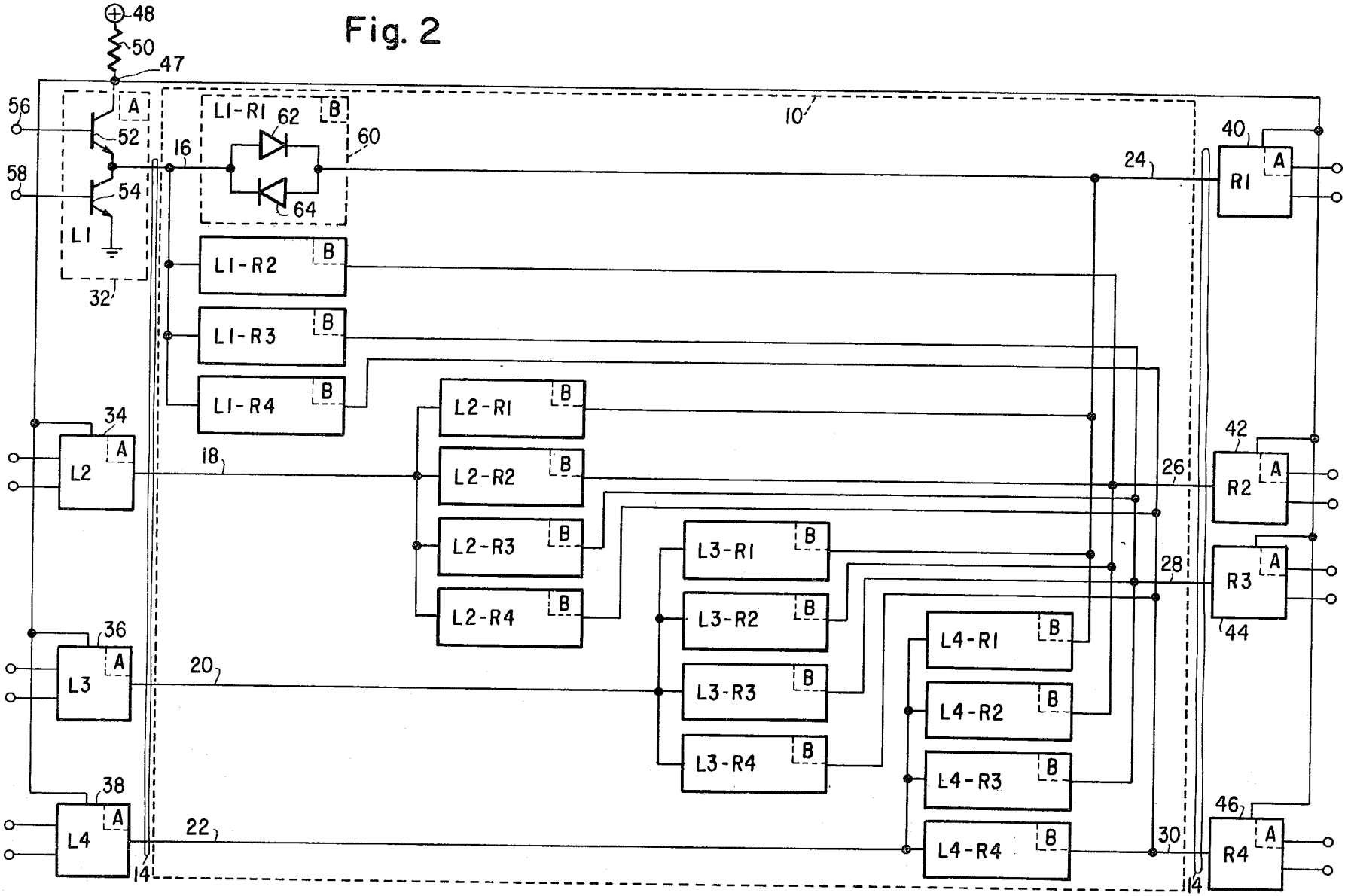
FIG. 2 is a schematic circuit diagram of a first illustrative display system constructed in accordance with the principles of this invention.

The arrangements shown in FIGS. 2 and 3 utilize arrays of display cells each of which includes two display elements connected in parallel and oppositely poled. In order to energize a selected display element, it is necessary to both select a particular display cell of the array and to also select a direction of current flow through that display cell. The circuitry shown in FIGS. 2 and 3 accomplish this desired result.

As shown in FIG. 2, in a first illustrative embodiment, the display 10 is a matrix array formed by a first plurality of conductors 16, 18, 20 and 22, and a second plurality of conductors 24, 26, 28 and 30. For purposes of illustration, the display 10 is shown as a 4×4 matrix but it is apparent that it may be expanded or contracted to any desired size, square or non-square, to meet a particular application. The conductors 16–30 form the leads 14 connected between the display 10 and the display controller 12 (FIG. 1) and are the only necessary connections therebetween. For purposes of description, the first plurality of conductors 16–22 will be termed the "LEFT" conductors and the second plurality of conductors 24–30 will be termed the "RIGHT" conductors. Although the conductors 16–22 have been designated the LEFT conductors and the conductors 24–30 have been designated the RIGHT conductors, it is understood that these conductors may also be designated the row or column conductors, respectively, as is commonly done when discussing a matrix array. Each of the conductors 16–30 is connected to a respective driving circuit 32, 34, 36, 38, 40, 42, 44 and 46. All of the driving circuits 32–46 may be incorporated as part of an integrated circuit chip which forms the display controller 12 (FIG. 1). Only the driving circuit 32 is shown in detail, all of the driving circuits 32–46 being identical as indicated by them having the designation A in the upper right corners thereof. The drivers 32–38 connected to the LEFT conductors 16–22 are also designated as drivers L1–L4, respectively. Similarly, the drivers 40–46 connected to the RIGHT conductors 24–30 are denoted R1–R4, respectively. All of the drivers 32–46 are connected to a first voltage source at a first voltage level at the point 47, supplied by a source 48 through a current limiting load resistor 50. Each of the drivers 32–46 includes a first transistor 52 and a second transistor 54 connected with their emitter-collector paths in series between the first voltage source at the point 47 and ground, which may be considered a second voltage source at a second voltage level differing from the first voltage level by a predetermined voltage difference. The base of the transistor 52 is connected to a control terminal 56 and the base of the transistor 54 is connected to a control terminal 58. The junction between the transistors 52 and 54 is connected to its respective LEFT or RIGHT conductor. When a positive voltage is applied to the control terminal 56, the transistor 52 becomes conductive to apply the first voltage level to the LEFT conductor 16. When a positive voltage is applied to the control terminal 58, the transistor 54 becomes conductive to apply the second voltage level (i.e. ground) to the LEFT conductor 16. It is understood that the first and second voltage levels need not be positive and ground, as illustrated in FIG. 2. The disclosed arrangement is adapted to work with differing voltage levels such as, for example, positive and negative or ground and negative, etc.

At the intersection point of each of the LEFT and RIGHT conductors 16–22 and 24–30, respectively, there is one of a plurality of identical display cells, each having the designation B in the upper right corner thereof. Only the display cell 60 which is coupled between the drivers L1 and R1 is shown in detail, the remaining display cells being of identical construction. The display cell 60 includes a pair of oppositely polarized display elements 62 and 64 connected in parallel. Illustratively, the display elements 62 and 64 may be light emitting diodes (LED's), but it is understood that display devices other than light emitting diodes, which supply their own diode action, can be utilized by placing external diodes, properly oriented, in series with each display element.

The arrangement of FIG. 2 operates by controlling the direction of current flow through the oppositely polarized display elements connected in parallel at the various crosspoints of the matrix 10. Thus, the display element 62 is energized by passing current through it from left to right as viewed in FIG. 2. This is accomplished by causing the transistor 52 within the driver 32 to become conductive and by causing the lower transistor (corresponding to the transistor 54) within the driver 40 to become conductive. In like manner, the display element 64 can be energized by causing the upper transistor in the driver 40 to be conductive and causing the lower transistor 54 in the driver 32 to be conductive. Thus, to enable a selected display element, one of the LEFT conductors is brought to either the first or the second voltage level while one of the RIGHT conductors is brought to the other of the first or second voltage levels.

As shown in FIG. 3, in a second illustrative embodiment, the display 10 is an array of display cells each of which includes a pair of oppositely polarized display elements connected in parallel. A plurality of conductors 70, 72, 74, 76, 78, 80 and 82, illustratively seven in number, form the leads 14 (FIG. 1) connecting the display 10 to the display controller 12 (FIG. 1). Each of the display cells is connected to a unique pair of the conductors 70–82 so that there is a display cell in every possible path between any two of the conductors 70–82. Each of the conductors 70–82 is connected to a respective driving circuit 84, 86, 88, 90, 92, 94 and 96. All of the driving circuits 84–96 may be incorporated as part of an integrated circuit chip which forms the display controller 12 (FIG. 1). Only the driving circuit 84 is shown in detail, all of the driving circuits 84–96 being identical as indicated by them having the designation C in the upper right corners thereof. For illustration purposes, each of the identical driving circuits 84–96 is identical with each of the driving circuits 32–46 (FIG. 2) and therefore no further description of them need be given.

The arrangement of FIG. 3 operates by controlling the direction of current flow through the oppositely polarized display elements connected in parallel between a pair of the conductors 70–82. Thus, the display element 98 is energized by turning on the upper transistor in the driver circuit 86 to apply a positive voltage from the source 48 to the conductor 72 and the lower transistor in the drive circuit 88 is turned on to apply ground to the conductor 74. Similarly, to energize the display element 100, which forms a part of the same display cell as the display element 98, the upper transistor in the drive circuit 88 is turned on and the lower transistor in the drive circuit 86 is turned on. Thus, to energize a selected display element, an upper transistor in one of the drive circuits 84–96 is turned on and a lower transistor in a different one of the drive circuits 84–96 is turned on.

The arrangement shown in FIG. 3 takes full advantage of the ability to multiplex some number of drivers (N), each capable of bidirectional current flow control, two at a time. As a result, the number of combinations of drivers available is $N(N-1)/2$. However, because of the bidirectional control of current flow, each of the possible selections can result in the operation of either of two possible display elements, thereby resulting in $N(N-1)$ useful selections using N drive circuits. When D display elements are to be controlled, it is seen that the relationship $N^2-N=D$ will suffice, where N is the number of drive circuits required. In this relationship, as D grows, N approaches $\sqrt{D}$ as a limit. This method, therefore, requires only slightly more than $\sqrt{D}$ leads, in fact only $\sqrt{D}+1$ leads, as a limit, to control D display elements, as contrasted with $\sqrt{2D}$ leads required by the arrangement shown in FIG. 2 and $2\sqrt{D}$ leads required by a conventional matrix arrangement.

Figure 4A:
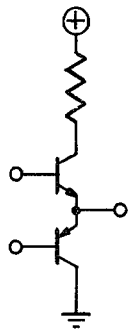
FIGS. 4A, 4B and 4C illustrate modifications of a portion of the systems shown in FIGS. 2 and 3.
Figure 4B:
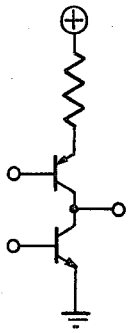
Figure 4C:
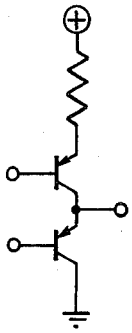

Although in FIGS. 2 and 3 the driving circuits have been shown as being constructed of a pair of NPN transistors, other arrangements are possible. For example, FIG. 4A illustrates an implementation utilizing a series connection of an NPN and a PNP transistor, FIG. 4B illustrates an implementation utilizing a series connection of a PNP and an NPN transistor and FIG. 4C illustrates an implementation utilizing serially connected PNP transistors. It is contemplated that other types of transistors, such as PMOS, NMOS, CMOS, VMOS, or the like, may also be utilized.

The arrangements shown in FIGS. 2 and 3 as utilizing light emitting diodes as the display elements have certain advantages. It will be noted that the selected display element regulates the voltage drop between the two enabled lines to the forward drop across the selected diode. Since all other possible paths between the two enabled lines in the arrangement of FIG. 2 have at least three forward biased diodes in them, current will flow only in the selected path. Similarly, in the arrangement of FIG. 3, all "sneak paths" will have at least two diodes in them.

An arrangement constructed in accordance with the principles of this invention possesses certain advantages when the driving circuitry is implemented utilizing integrated circuit technology. The number of leads required for operating the matrix is reduced over conventional techniques. Thus, as shown in FIG. 2, only eight leads are required for selecting one of 32 display elements whereas in a conventional matrix array utilizing 8 leads, at most only 16 display elements could be selectively driven. Similarly, with the arrangement shown in FIG. 3, only seven leads are required for selecting one of 42 display elements. Accordingly, the number of connections to an integrated circuit driving chip is reduced and the overall circuit cost is reduced by decreasing the number of required leads and connections.

Accordingly, there has been disclosed an improved display system. It is understood that the above-described embodiments are merely illustrative of the application of the principles of this invention. Numerous other embodiments may be devised by those skilled in the art without departing from the spirit and the scope of the invention, as defined by the appended claims.

I claim:

1. A display system comprising:

a first plurality of conductors;

a second plurality of conductors;

a plurality of pairs of oppositely poled and parallel connected display elements arranged at respective intersection points of a matrix array of said first and second pluralities of conductors;

a first voltage source at a first voltage level;

a second voltage source at a second voltage level differing from said first voltage level by a predetermined voltage difference; and means for connecting one of said first or second voltage sources to one of said first plurality of conductors and the other of said first or second voltage sources to one of said second plurality of conductors;

whereby a selected one of the pair of display elements at the intersection point of said one of said first plurality of conductors and said one of said second plurality of conductors has said predetermined voltage difference applied thereacross with appropriate polarity to energize only said selected display element.

2. The display system according to claim 1 wherein said connecting means includes a plurality of pairs of controllable unidirectional current carrying devices, each pair being serially connected with the same polarity between said first and said second voltage sources with the junction between said devices within a pair being connected to a respective one of said first and second pluralities of conductors.

3. A display system comprising:

a plurality of conductors;

a plurality of display cells each of which includes a pair of oppositely poled and parallel connected display elements;

means for connecting each of said display cells to a unique pair of said plurality of conductors so that every one of said plurality of conductors is paired with every other one of said plurality of conductors through a respective one of said display cells;

a first voltage source at a first voltage level;

a second voltage source at a second voltage level differing from said first voltage level by a predetermined voltage difference; and selection means for connecting one of said first or second voltage sources to one of said plurality of conductors and the other of said first or second voltage sources to a different one of said plurality of conductors;

whereby a selected one of a pair of display elements in the display cell which is connected across said one and said different one of said plurality of conductors has said predetermined voltage difference applied thereacross with appropriate polarity to energize only said selected display element.

4. The display system according to claim 3 wherein said selection means includes a plurality of pairs of controllable unidirectional current carrying devices, each pair being serially connected with the same polarity between said first and said second voltage sources with the junction between said devices within a pair being connected to a respective one of said plurality of conductors.

5. The display system according to claims 1, 2, 3, or 4 wherein each of said display elements comprises a light emitting diode.

* * * * *